US010145615B2

(12) United States Patent
Chen

(10) Patent No.: US 10,145,615 B2
(45) Date of Patent: Dec. 4, 2018

(54) STRUCTURES OF COMPOSITE CRUCIBLES AND HIGH TEMPERATURE ADIABATIC METHOD IN ARC HEATING PROCESS THEREOF

(71) Applicant: National Tsing Hua University, Hsinchu (TW)

(72) Inventor: Swe-Kai Chen, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 307 days.

(21) Appl. No.: 15/144,865

(22) Filed: May 3, 2016

(65) Prior Publication Data

US 2017/0108274 A1 Apr. 20, 2017

(30) Foreign Application Priority Data

Oct. 14, 2015 (TW) ..... 104133734 A

(51) Int. Cl.

| | |
|---|---|
| ***H05B 7/18*** | (2006.01) |
| ***F27D 11/08*** | (2006.01) |
| ***F27B 14/04*** | (2006.01) |
| ***F27B 14/20*** | (2006.01) |

(52) U.S. Cl.

CPC ..... *F27D 11/08* (2013.01); *F27B 14/04* (2013.01); *F27B 14/20* (2013.01)

(58) Field of Classification Search

CPC ..... F27B 14/04; F27B 14/20; F27D 11/08
USPC ..... 373/2, 60
See application file for complete search history.

(56) References Cited

U.S. PATENT DOCUMENTS 6,290,748 B1 * 9/2001 Jha ..... C22C 1/1036 420/590
2008/0028891 A1 * 2/2008 Calnan ..... B22F 3/008 76/108.4

* cited by examiner

*Primary Examiner* — Hung D Nguyen
(74) *Attorney, Agent, or Firm* — Locke Lord LLP; Tim Tingkang Xia, Esq.

(57) ABSTRACT

A structure of composite crucibles and a high temperature adiabatic method in an arc heating process are disclosed. The structure may include a conventional water-cooled copper platform on which one or more graphite platform(s) are disposed and the topmost graphite platform is configured for disposing one or more metallic specimen(s). When arc smelts the metallic specimen(s) in the furnace in vacuum, and the heat of the metallic specimen(s) is transferred to the graphite platform, the graphite platform can reduce heat loss and improve heat preservation so as to cause the metallic specimen(s) to remain stable for the process of heating and melting to complete. The heat of the graphite platform is further transferred to the copper platform for lowering the temperature of the graphite platform.

8 Claims, 15 Drawing Sheets

STRUCTURES OF COMPOSITE CRUCIBLES AND HIGH TEMPERATURE ADIABATIC METHOD IN ARC HEATING PROCESS THEREOF

CROSS REFERENCE TO RELATED APPLICATION

This application also claims priority to Taiwan Patent Application No. 104133734 filed in the Taiwan Patent Office on Oct. 14, 2015, the entire content of which is incorporated herein by reference.

BACKGROUND OF THE INVENTION

1. Field of the Invention

The disclosure is related to a structure of composite crucibles and a high temperature adiabatic method in an arc heating process thereof, and more particularly related to a structure of composite crucibles used in an arc heating process.

2. Descriptions of the Related Art

Arc melting is a process of directly heating and melting metals by an arc in a furnace in vacuum, which mainly generates arc by ionizing noble gas. In order to stabilize the arc, in general, a direct current (DC) is supplied. Furnaces can be categorized into self-consumption furnaces and non-consumption furnaces by whether the furnaces are consumed (melted) or not, and self-consumption furnaces are used in most of the industrial applications.

Since a great amount of heat is generated during the arc melting, and the temperature can be raised to higher than 3600° C., which is higher than the melting points of normal available materials such as copper molds, which can transfer heat rapidly, used during the conventional melting process, the heat is dissipated by water-cooling. Otherwise, the crucibles used in melting will be melted and cause undesired dangerous situations.

The above mentioned melting, cooling and molding technics of the arc cooperating with water-cooled copper molds have the advantage of low contamination to the materials being melted, while being associated with the disadvantage of the generation of the thermal stress that could be strong enough to result in cracking. Such thermal stress is generated since the melting materials have been closely in contact with the water-cooled copper molds and the melting materials have a large gradient in temperature. In addition, regarding the melting materials having a melting point higher than 3000° C., the melting, cooling and molding technics of the arc cooperating with water-cooled copper molds will be subject to the phenomena that the materials can hardly be melted, which also makes melting more difficult.

Therefore, in order to overcome the above problem in arc melting process, one can dispose one or more graphite crucible above the water-cooled copper mold. Graphite is one of the light elements that can withstand a high temperature, and the melting point of graphite is 3850° C. In addition, electrical conductivity and thermal conductivity of graphite are comparable to metals, which are 4 times greater than stainless steel, 2 times greater than carbon steel, 3-3.5 times greater than lead, and about 100 times greater than other metals. However, when the temperature is higher, the thermal conductivity is decreased, which may cause the material to enter into an adiabatic condition under an extremely high temperature. Thus, using graphite crucibles can reduce heat loss and thermal insulation can be improved, as compared with water-cooled copper molds. Further, the materials having a melting point higher than 3000° C. can still be used in the melting processes.

SUMMARY OF THE INVENTION

The disclosure relates to a structure of composite crucibles and a high temperature adiabatic method in an arc heating process thereof, which applies a composite crucible technic applying a graphite crucible combined with a water-cooled copper mold, and is mainly used in a high temperature adiabatic method in an arc heating process.

A structure of composite crucibles includes: a copper platform, disposed inside a furnace for directly heating and melting metals by an arc; and one or more graphite platform stacked with each other, disposed on the copper platform, wherein the graphite platform disposed topmost is configured for disposing one or more metallic specimen(s), and the furnace arc melts the metallic specimen(s).

More specifically, the graphite platform contacting with the copper platform contacts with the copper platform through at least two points, such that the graphite platform can be fixed on the copper platform.

More specifically, any graphite platform contacts with another graphite platform through at least two points, such that any graphite platforms can be fixed on another graphite platform.

More specifically, the area of the copper platform is greater than the area of the graphite platform.

More specifically, the graphite platform configured for disposing the metallic specimen(s) has at least one hole therein, and the hole is configured for disposing the metallic specimen(s).

More specifically, the peripheral of the surface of the hole of the graphite platform configured for disposing the metallic specimen(s) has at least one groove, and the groove can fix the metallic specimen(s) to the hole more firmly.

More specifically, the graphite platform configured for disposing the metallic specimen(s) has at least one hole therein, and the hole is configured for disposing the metallic specimen(s), one or more graphite platform disposed between the graphite platform configured for disposing the metallic specimen(s) and the copper platform has at least one hole configured for connecting with the hole inside the graphite platform configured for disposing the metallic specimen(s).

More specifically, the graphite platform configured for disposing the metallic specimen(s) has at least one hole therein, and the hole is configured for disposing the metallic specimen(s). The graphite platforms may be configured for disposing the metallic specimen(s) and the copper platform and the copper platform has at least one hole configured for connecting with the hole inside the graphite platform configured for disposing the metallic specimen(s).

More specifically, the bottom of the copper platform has a water-cooled device for exchanging heat.

A high temperature adiabatic method in an arc heating process, including:

(1) disposing a copper platform inside a furnace for directly heating and melting metals by an arc, the bottom of the copper platform having a water-cooled device, one or more platform stacked with each other being disposed on the copper platform, the graphite platform disposed topmost being configured for disposing one or more metallic specimen(s); and (2) when the arc melting the metallic specimen(s) in the furnace in vacuum, and the heat of the metallic specimen(s)

being transferred to the graphite platform, the graphite platform reducing heat loss and improving heat preservation so as to allow the metallic specimen(s) to remain stable for completing the process of heating and melting, and the heat of the graphite platform being further transferred to the copper platform for lowering the temperature of the graphite platform.

More specifically, the graphite platform is capable of contacting with the copper platform by at least two points, such that the graphite platform can be fixed on the copper platform. With fewer contact points between the graphite platform and the copper platform, the thermal insulation can be better.

More specifically, when more than one graphite platform is disposed on the copper platform, any two of the graphite platforms can contact with each other by two points, such that the graphite platforms can be fixed on another graphite platform to form a multi-platform structure. Since such structure may only rely on the same two points to be fixed to the copper platform, the entire thermal insulation for the structure could be better.

More specifically, the heat of the graphite platform transferred to the copper platform can be brought away by the water-cooled device through heat exchanging.

More specifically, one graphite platform configured for disposing the metallic specimen(s) is disposed on the copper platform, the graphite platform configured for disposing the metallic specimen(s) has at least one hole for disposing the metallic specimen(s), when melting the metallic specimen(s), the casing solution formed after melting flows into the hole for casting, and when the casting solution is cooled down in the hole, casts are formed with different appearances based on the appearances of the hole of the graphite platform configured for disposing the metallic specimen(s).

More specifically, the hole of the graphite platform configured for disposing the metallic specimen(s) is a penetrating hole, such that when the metallic specimen(s) is melted, the casting solution formed after melting flows into the hole.

More specifically, the copper platform has at least one hole, when the metallic specimen(s) is melted, the casing solution formed after melting flows from the hole for disposing the metallic specimen(s) and into the hole of the copper platform for casting, and when the casting solution is cooled down in the hole, casts are formed with different appearances based on the appearances of the hole of the graphite platform configured for disposing the metallic specimen(s) or the appearances of the hole of the copper platform.

More specifically, at least one graphite platform is disposed on the surface of the copper platform, wherein the graphite platform configured for disposing the metallic specimen(s) has at least one hole configured for disposing the metallic specimen(s), when the metallic specimen(s) is melted, the casting solution formed after melting flows into the hole for casting, and when the casting solution is cooled down in the hole, casts are formed with different appearances based on the appearances of the hole of the graphite platform configured for disposing the metallic specimen(s).

More specifically, the hole configured for disposing the metallic specimen(s) is a penetrating hole, such that when the metallic specimen(s) is melted, the casting solution formed after melting flows into the hole and contacts with the next graphite platform.

More specifically, one or more graphite platform(s) disposed between the graphite platform configured for disposing the metallic specimen(s) and the copper platform has at least one hole, when the metallic specimen(s) is melted, the casting solution formed after melting flows from the hole configured for disposing the metallic specimen(s) and into the one or more hole(s) connecting with the hole configured for disposing the metallic specimen(s) for casting, and when the casting solution is cooled down in the holes, casts are formed with different appearances based on the appearances of the holes of the graphite platforms.

More specifically, the hole of the graphite platform contacting with the surface of the copper platform is a penetrating hole, such that when the metallic specimen(s) is melted, the casting solution formed after melting flows from the hole configured for disposing the metallic specimen(s), and into the one or more hole(s) connecting with the hole configured for disposing the metallic specimen(s), and contacts with the copper platform.

More specifically, the copper platform has at least one hole, when the metallic specimen(s) is melted, the casing solution formed after melting flows from the hole for disposing the metallic specimen(s), through the one or more hole of the graphite platform disposed between the graphite platform configured for disposing the metallic specimen(s) and the copper platform, and into the hole of the copper platform for casting, and when the casting solution is cooled down in the holes, casts are formed with different appearances based on the appearances of the holes of the graphite platforms or the appearance of the hole of the copper platform.

BRIEF DESCRIPTION OF THE DRAWINGS

In order to more clearly illustrate the embodiments of the disclosure, the accompanying drawings for illustrating the technical solutions and the technical solutions of the disclosure are briefly described as below.

DETAILED DESCRIPTION OF THE PREFERRED EMBODIMENTS

The following description with reference to the accompanying drawings is provided to clearly and completely explain the exemplary embodiments of the disclosure. It is apparent that the following embodiments are merely some embodiments of the disclosure rather than all embodiments of the disclosure. According to the embodiments in the disclosure, all the other embodiments attainable by those skilled in the art without creative endeavor belong to the protection scope of the disclosure.

Figure 1A:
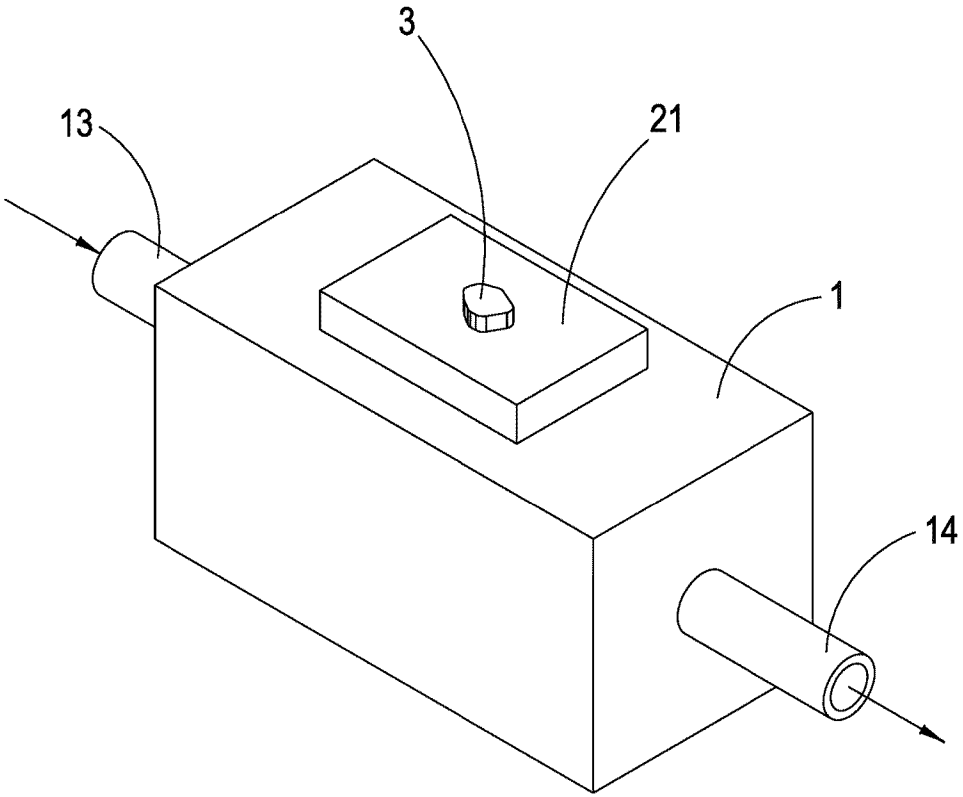
FIG. 1A is a schematic view of the structure composite crucibles according to the first embodiment of the structures of composite crucibles and high temperature adiabatic method in arc heating process with such disclosed structures.
Figure 1B:
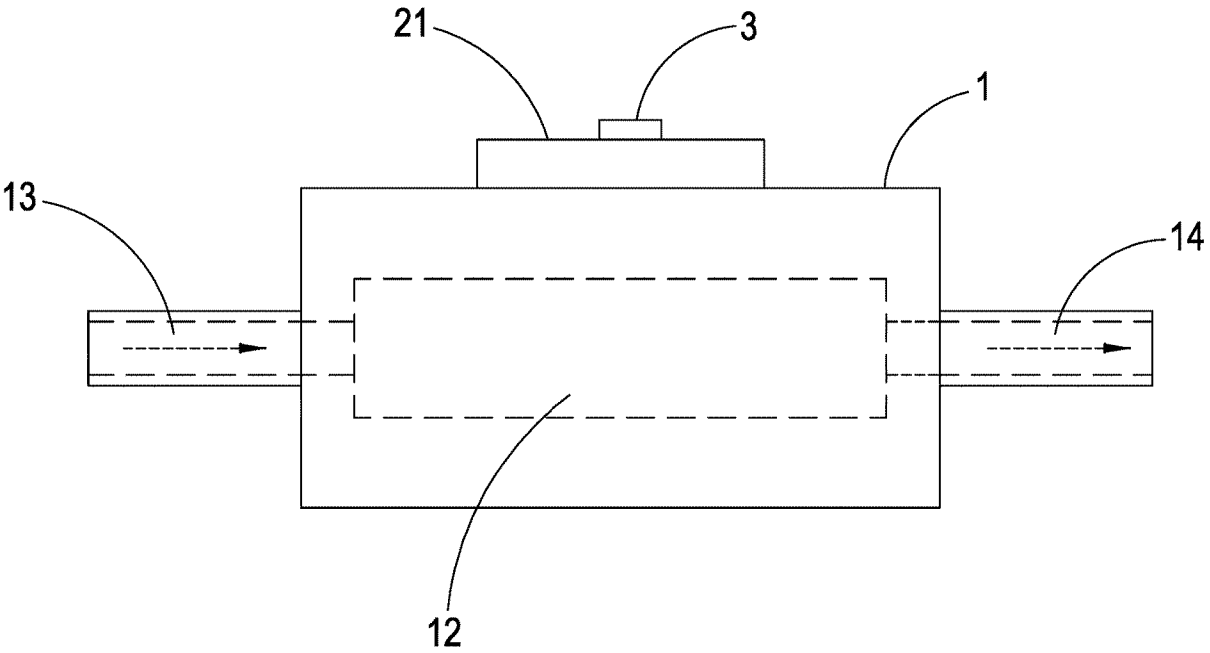
FIG. 1B is an internal schematic view of the structure composite crucibles according to the first embodiment of the structures of composite crucibles and high temperature adiabatic method in arc heating process with such disclosed structures.

Refer to FIGS. 1A and 1B, which are a schematic view and an internal schematic view, respectively, according to the first embodiment of the structures of composite crucibles and high temperature adiabatic method in arc heating process with such disclosed structures. According to the figures, the structure of composite crucibles may include a copper platform 1 and a graphite platform 21. The copper platform 1 is disposed inside a furnace (not shown in the figures) for directly heating and melting metals by an arc. The graphite platform 21 is disposed on the copper platform 1. The graphite platform 21 is capable of disposing one or more metallic specimen(s) 3, and the furnace arc melts the metallic specimen(s) 3.

The metallic specimen(s) 3 may be disposed on any positions of the graphite platform 21. Thus, when the arc smelts the metallic specimen(s) 3 in the furnace in vacuum, and the heat of the metallic specimen(s) 3 is transferred to the graphite platform 21. Graphite is one of the light elements that can withstand under a high temperature best, and the melting point of graphite is 3850° C. In addition, electrical conductivity and thermal conductivity of the graphite are comparable to metals, which are 4 times greater than stainless steel, 2 times greater than carbon steel, 3-3.5 times greater than lead, and about 100 times greater than other metals. However, when the temperature is higher, the thermal conductivity is decreased, pushing the graphite to be close to an adiabatic condition (regarding graphite, when higher than 1000° C., thermal diffusivity is lower than 0.2 [$10^{-4}$ $m^2/s$], and when higher than 1400° C., thermal conductivity coefficient [W/(m·K)] is lower than 60) under an extremely high temperature. Thus, using graphite crucibles can reduce heat loss and thermal insulation can be improved. Further, the materials having a melting point higher than 3000° C. can still be used in the melting processes.

Thus, the graphite platform 21 can reduce heat loss and improve heat preservation, such that the graphite platform 21 can help the metallic specimen(s) 3 to remain stable for completing the process of heating and melting (and the graphite platform 21 do not melt due to the high temperature process), and the heat of the graphite platform 21 is further transferred to the copper platform 1, and the water-cooled device 12 disposed at the bottom of the copper platform 1 is connected with a water inlet 13 and a water outlet 14, such that the heat is brought away by heat exchanging through the cooling water. With the above arrangement, the temperature of the graphite platform 21 could be effectively controlled.

Figure 2A:
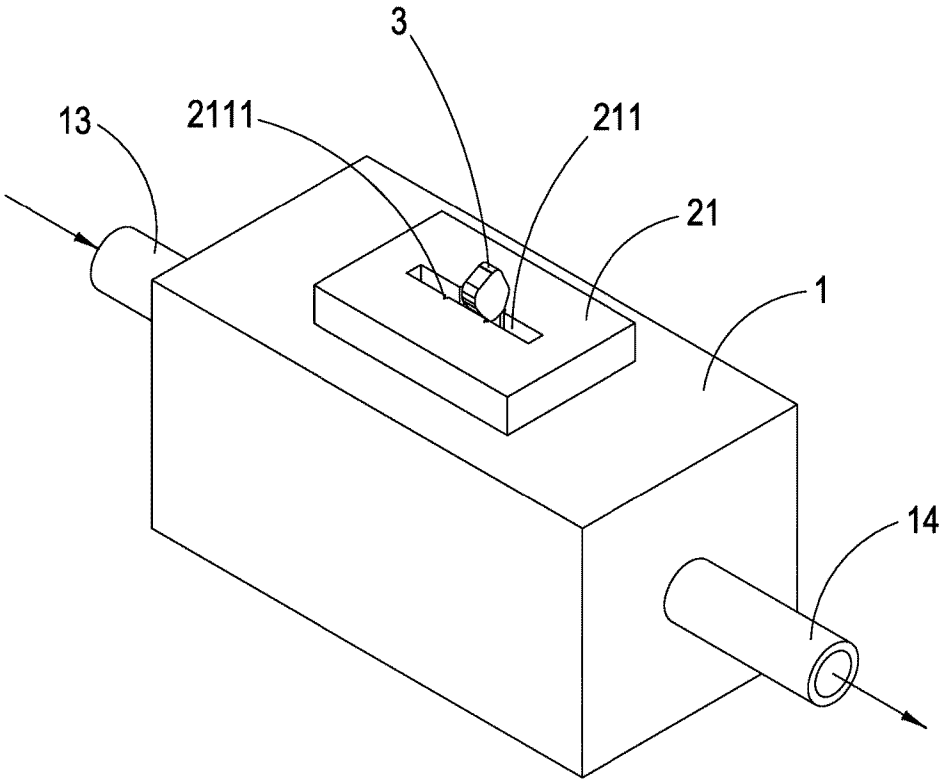
FIG. 2A is a schematic view of the structure composite crucibles according to the second embodiment of the structures of composite crucibles and high temperature adiabatic method in arc heating process with such disclosed structures.

As shown in FIG. 2A, the graphite platform 21 has hole 211 therein. The peripheral of the surface of hole 211 has a plurality of grooves 2111. As shown in the figure, the metallic specimen(s) 3 can be fixed and stand in hole 211 by the grooves 2111. Thus, there are only two contact points between the metallic specimen(s) 3 and the graphite platform 21. When the contact area between the metallic specimen(s) 3 and the graphite platform 21 is smaller, the temperature of the graphite platform 21 decreases more slowly, such that the graphite platform 21 can remain in the adiabatic condition longer, and the problem of the gradient in temperature and compositions between the upper part and the lower part of the metallic specimen(s) 3 disposed on the graphite platform 21 can be reasonably controlled.

Figure 2B:
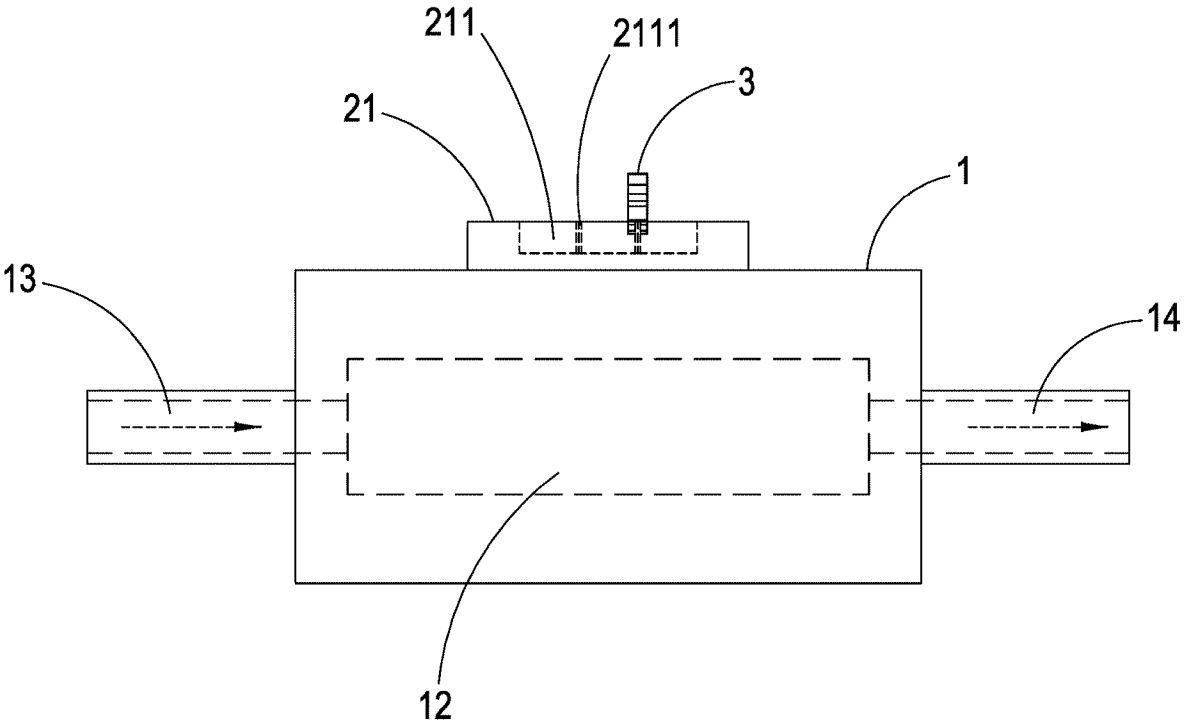
FIG. 2B is an internal schematic view of the structure composite crucibles according to the first aspect of the second embodiment of the structures of composite crucibles and high temperature adiabatic method in arc heating process with such disclosed structures.

As shown in FIG. 2B, when the metallic specimen(s) 3 is melted, the casing solution formed after melting flows into hole 211 for casting, and when the casting solution is cooled down in the hole, casts are formed with different appearances based on the appearances of hole 211 in the graphite platform 21. For example, when hole 211 is cylindrical, the casts formed by casting are cylindrical in shape. The conventional arc melting process, which forms casts with irregular shapes and different sizes, it is inconvenient for the subsequent processing to be performed. However, according to one embodiment of the present disclosed process for arc melting, casting and the formed casts are cylindrical or more regular in appearance, which may render subsequent processing (such as cutting and so forth) less challenging.

Figure 2C:
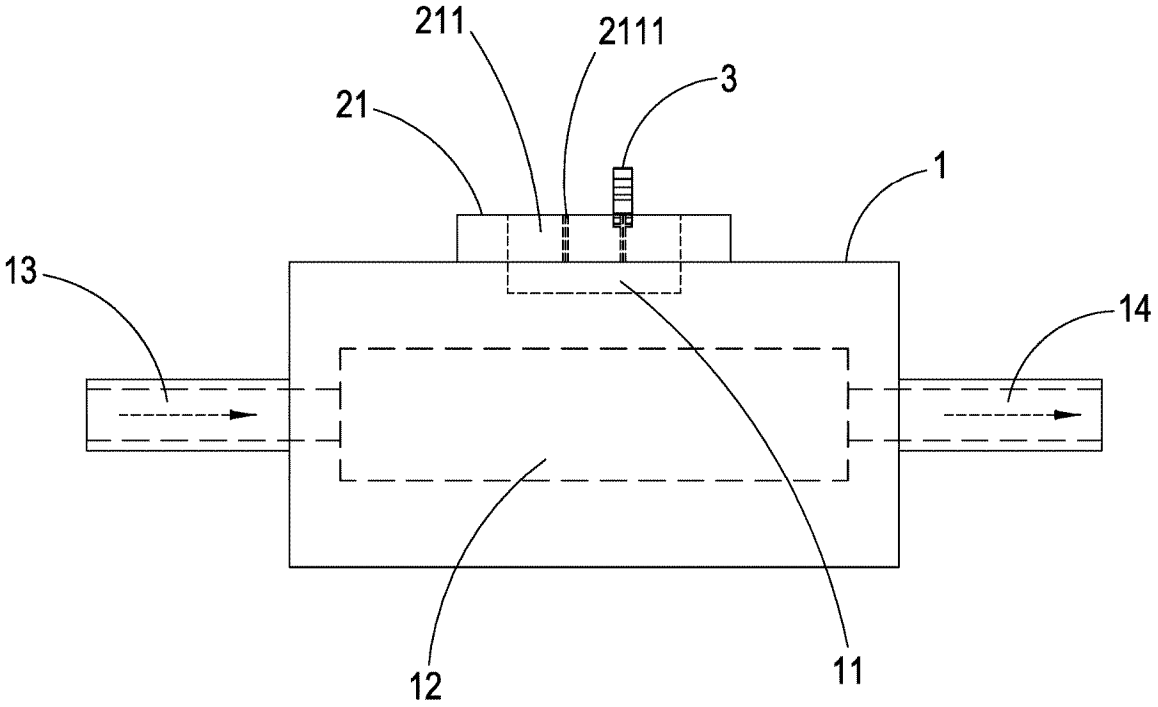
FIG. 2C is an internal schematic view of the structure composite crucibles according to the second aspect of the second embodiment of the structures of composite crucibles and high temperature adiabatic method in arc heating process with such disclosed structures.

As shown in FIG. 2C, hole 211 can be a penetrating hole. If the copper platform 1 has hole 11, the casting solution formed after melting flows from hole 211 and into hole 11.

Further, when the casting solution formed after melting is cooled down, casts are formed with different appearances based on the appearances of holes 211 and 11; in addition, when the copper platform 1 does not have a hole like hole 11, the casting solution formed after melting flows through hole 211 and directly contacts with the copper platform 1.

Figure 3:
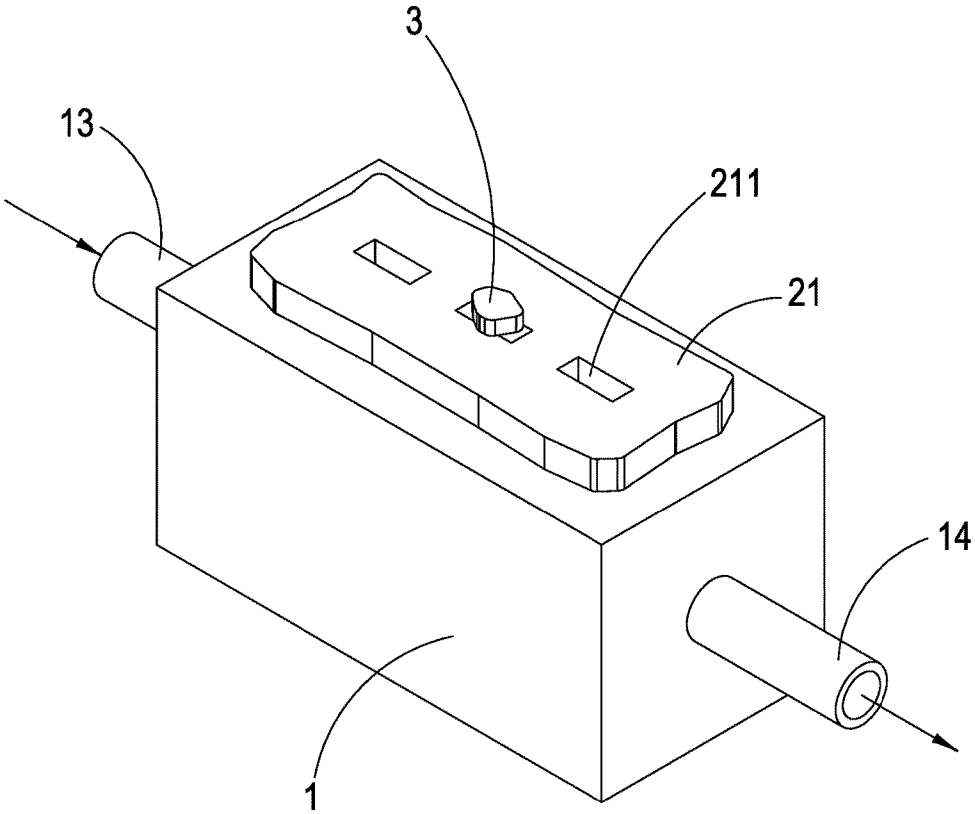
FIG. 3 is a schematic view of the structure composite crucibles according to the third embodiment of the structures of composite crucibles and high temperature adiabatic method in arc heating process with such disclosed structures.

As shown in FIG. 3, the graphite platform 21 can have more than one hole 211*s*, which may be fully penetrated or not. In addition, corresponding to the hole 211*s*, the copper platform 1 can further have one to three hole 11(s) or does not have any hole 11.

Figure 4A:
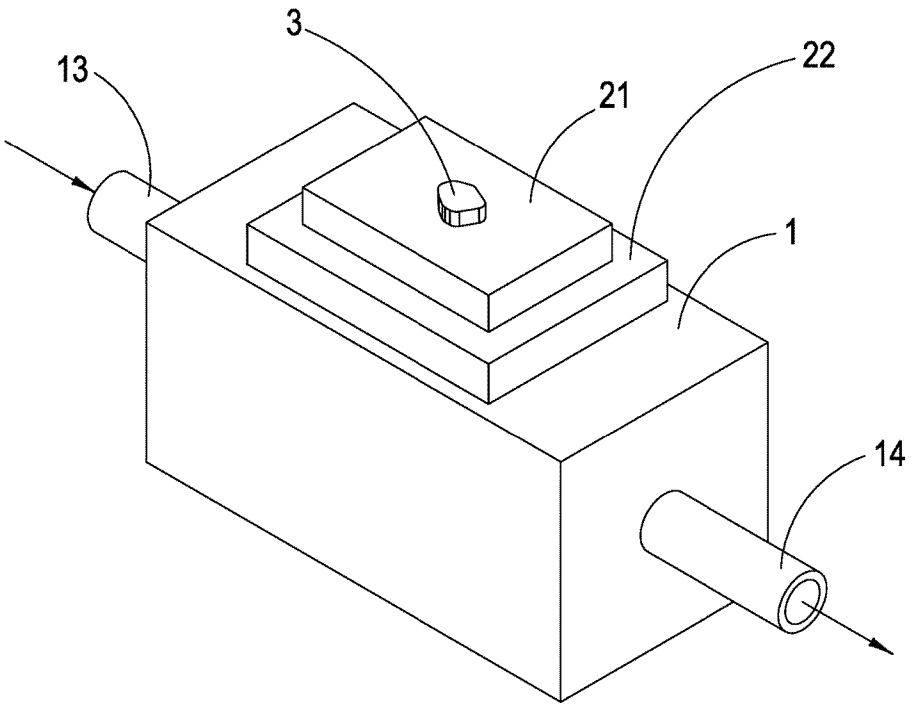
FIG. 4A is a schematic view of the structure composite crucibles according to the fourth embodiment of the structures of composite crucibles and high temperature adiabatic method in arc heating process with such disclosed structures.
Figure 4B:
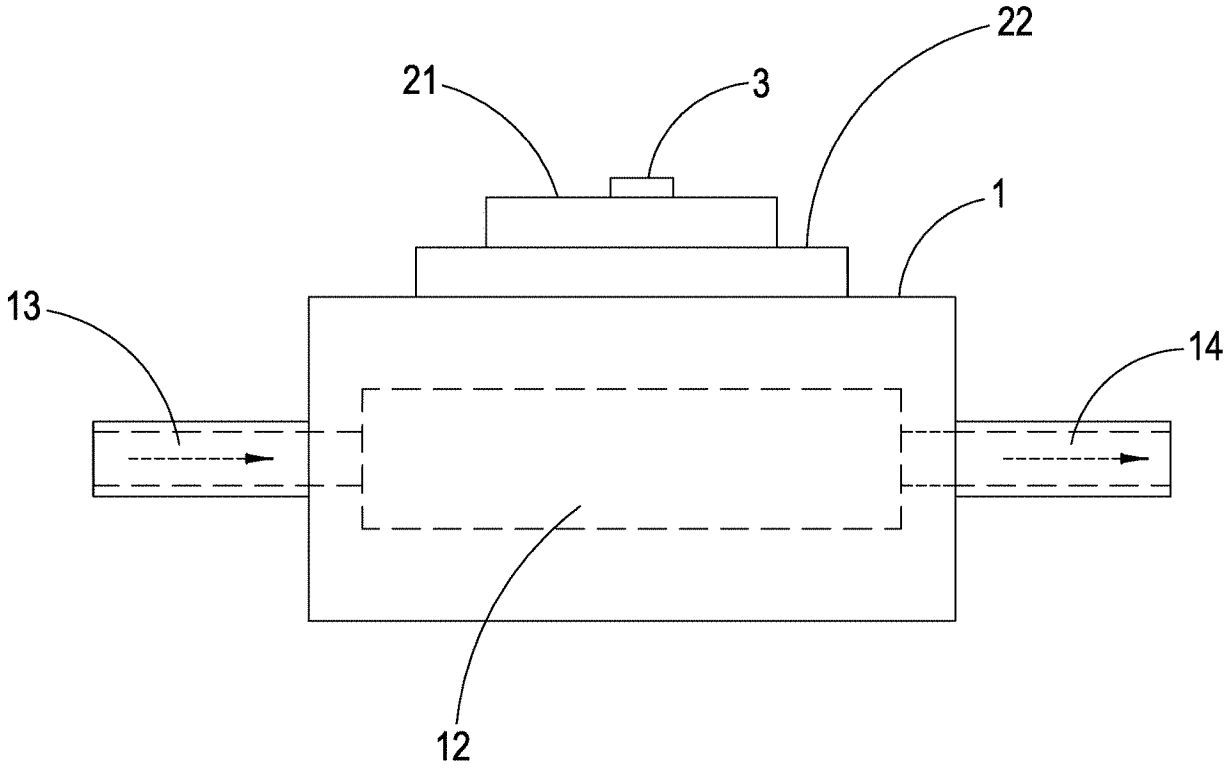
FIG. 4B is an internal schematic view of the structure composite crucibles according to the fourth embodiment of the structures of composite crucibles and high temperature adiabatic method in arc heating process thereof with such disclosed structures.

As shown in FIG. 4A, one or more graphite platform 22 is disposed between the graphite platform 21 and the copper platform 1. In this embodiment, one graphite platform 22 is disposed between the graphite platform 21 and the copper platform 1. As shown in FIG. 4B, when the metallic specimen(s) 3 is melted, the heat of the metallic specimen(s) 31 is transferred to the graphite platform 21, the heat of the graphite platform 21 is further transferred to the graphite platform 22, and the heat of the graphite platform 22 is further transferred to the copper platform 1, and the water-cooled device 12 disposed at the bottom of the copper platform 1 is connected with a water inlet 13 and a water outlet 14, allowing for the heat is brought away by heat exchanging through the cooling water. Consequently, the temperature of the graphite platform 21 may be effectively lowered.

Figure 5A:
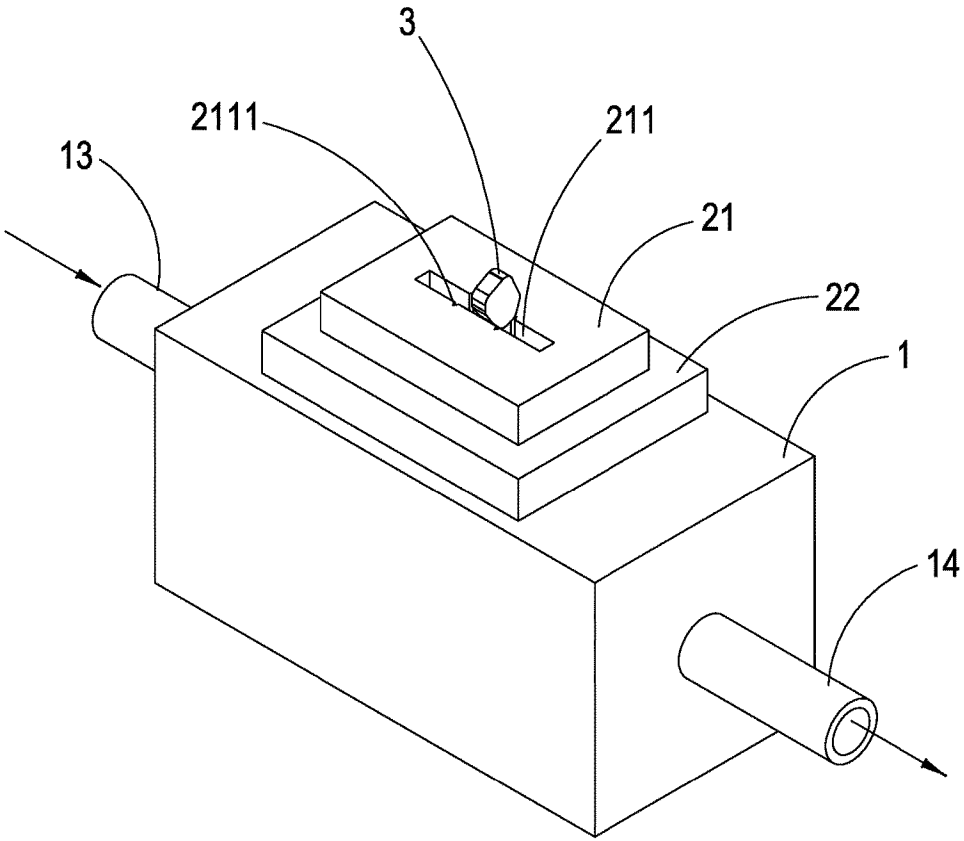
FIG. 5A is a schematic view of the structure composite crucibles according to the fifth embodiment of the structures of composite crucibles and high temperature adiabatic method in arc heating process with such disclosed structures.

As shown in FIG. 5A, the graphite platform 21 has hole 211 therein. The peripheral of the surface of hole 211 has a plurality of grooves 2111. As shown in the figure, the metallic specimen(s) 3 can be fixed and stand in hole 211 by the grooves 2111. Thus, there are only two contact points between the metallic specimen(s) 3 and the graphite platform 21. When the contact area between the metallic specimen(s) 3 and the graphite platform 21 is smaller, the temperature of the graphite platform 21 decreases more slowly, such that the graphite platform 21 may remain in the adiabatic condition longer, minimizing the problems of the undesired gradient in temperature and compositions between the upper part and the lower part of the metallic specimen(s) 3 disposed on the graphite platform 21.

Figure 5B:
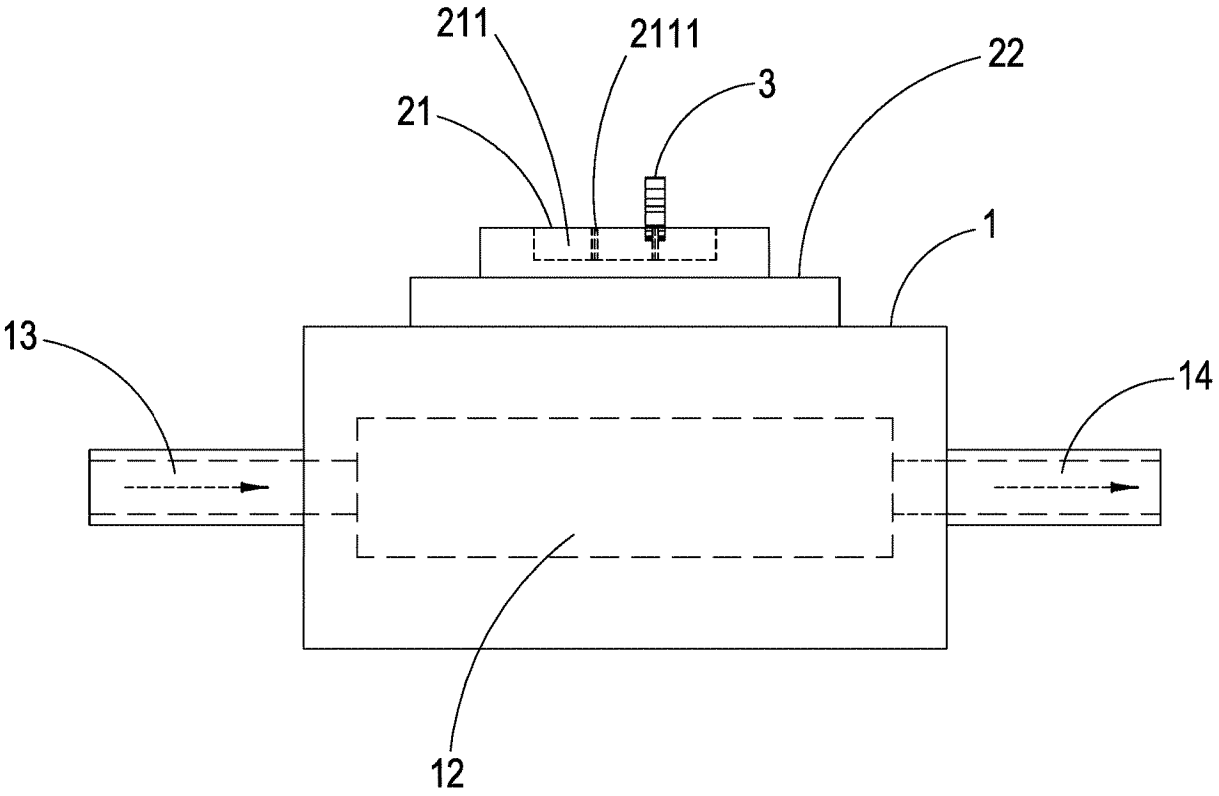
FIG. 5B is an internal schematic view of the structure composite crucibles according to the first aspect of the fifth embodiment of the structures of composite crucibles and high temperature adiabatic method in arc heating process thereof with such disclosed structures.

As shown in FIG. 5B, when the metallic specimen(s) 3 is melted, the casing solution formed after melting flows into hole 211. The heat for melting the metallic specimen(s) 3 is transferred to the graphite platform 21, the heat of the graphite platform 21 is further transferred to the graphite platform 22, and the heat of the graphite platform 22 is further transferred to the copper platform 1, and the water-cooled device 12 disposed at the bottom of the copper platform 1 is connected with a water inlet 13 and a water outlet 14, allowing for the heat to be brought away by heat exchanging through the cooling water. Thus, the temperature of the graphite platform 21 may be lowered. When the casting solution formed after melting is cooled down, casts are formed with different appearances based on the appearances of hole 211 in the graphite platform 21.

Figure 5C:
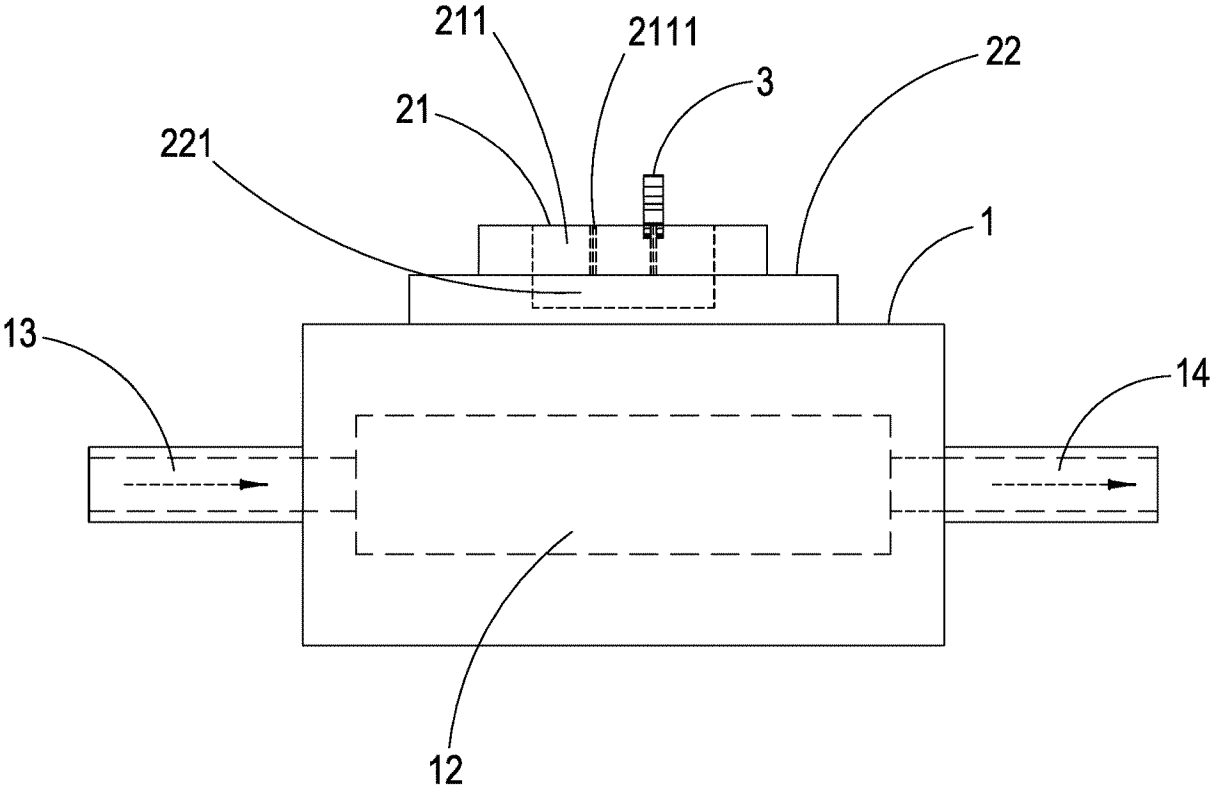
FIG. 5C is an internal schematic view of the structure composite crucibles according to the second aspect of the fifth embodiment of the structures of composite crucibles and high temperature adiabatic method in arc heating process thereof with such disclosed structures.

As shown in FIG. 5C, hole 211 can be a penetrated hole. If the graphite platform 22 has a hole 221, the casting solution formed after melting flows from hole 211 and then into hole 221. Further, when the casting solution formed after melting is cooled down, casts are formed with different appearances based on the appearances of holes 211 and 221; in addition, when the graphite platform 22 does not have a hole 221, the casting solution formed after melting flows through hole 211 and directly contacts with the surface of the graphite platform 22.

Figure 5D:
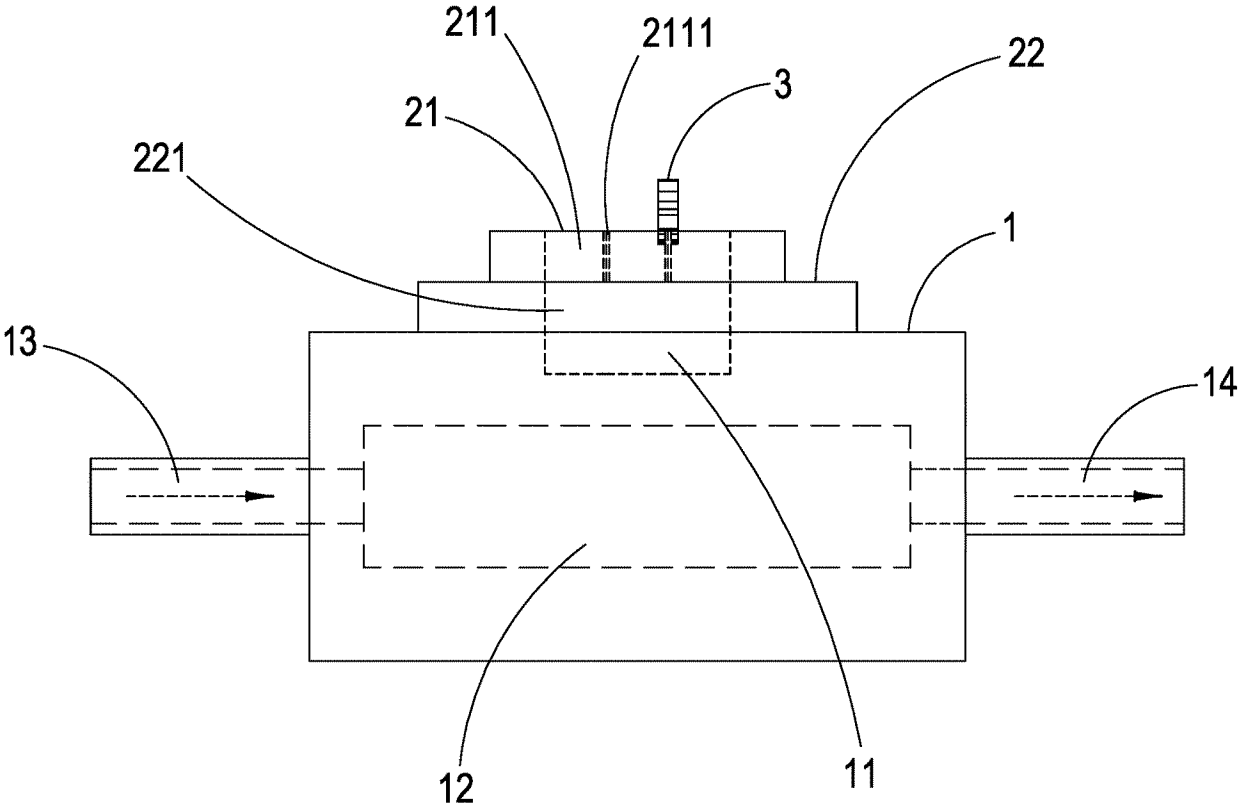
FIG. 5D is an internal schematic view of the structure composite crucibles according to the third aspect of the fifth embodiment of the structures of composite crucibles and high temperature adiabatic method in arc heating process with such disclosed structures.

As shown in FIG. 5D, holes 211 and 221 can be penetrating holes. If the copper platform 1 has a hole 11, the casting solution formed after smelting flows from holes 211 and 221 and then into hole 11. Further, when the casting solution formed after melting is cooled down, casts are formed with different appearances based on the appearances of holes 211, 221 and 11; in addition, when the copper platform 1 does not have a hole 11, the casting solution formed after melting flows through holes 211 and 221 and directly contacts with the surface of the copper platform 1.

Figure 6A:
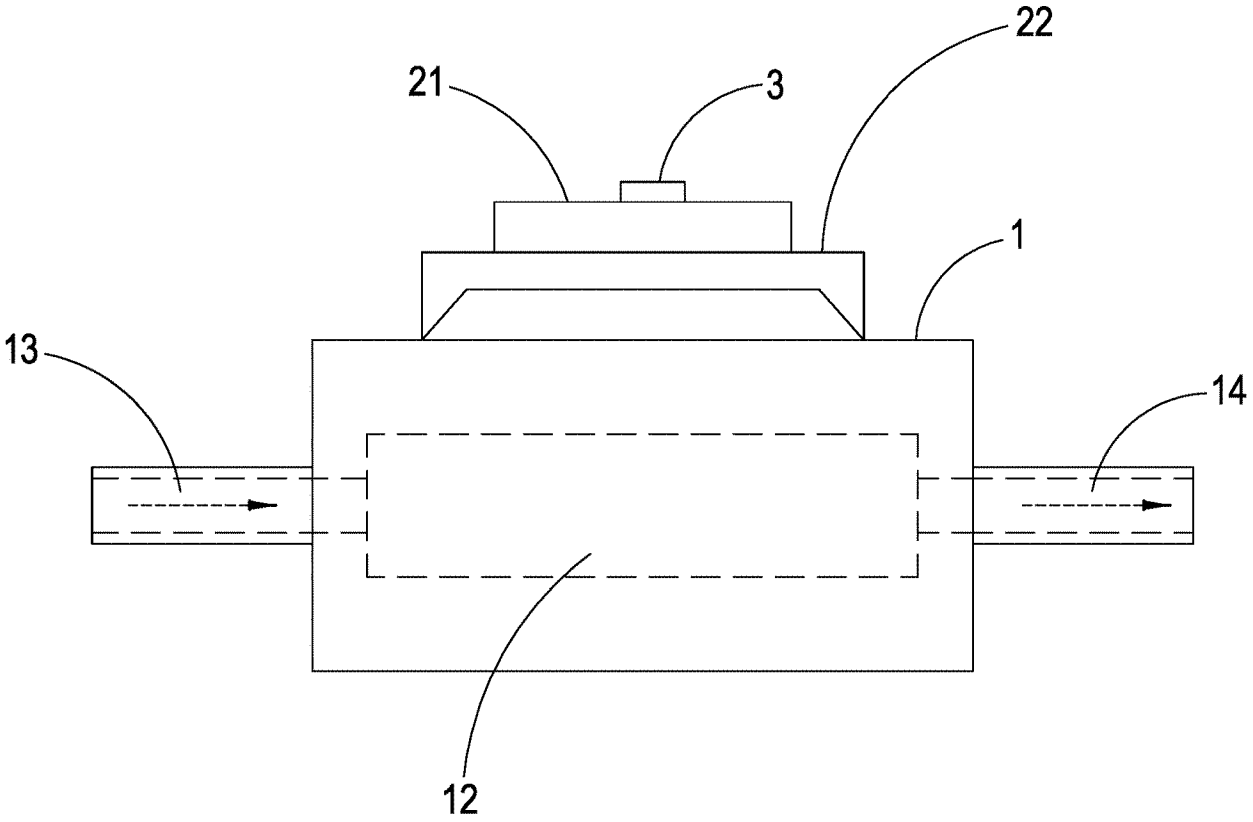
FIG. 6A is an internal schematic view of the structure composite crucibles according to the first aspect of the sixth embodiment of the structures of composite crucibles and high temperature adiabatic method in arc heating process with such disclosed structures.

As shown in FIG. 6A, the graphite platform 22 contacts with the copper platform 1 through at least two points or two lines, such that the graphite platform 22 can be fixed on the copper platform 1, and there are fewer contacts between the graphite platform 22 and the copper platform 1, leading to better and longer thermal insulation.

Figure 6B:
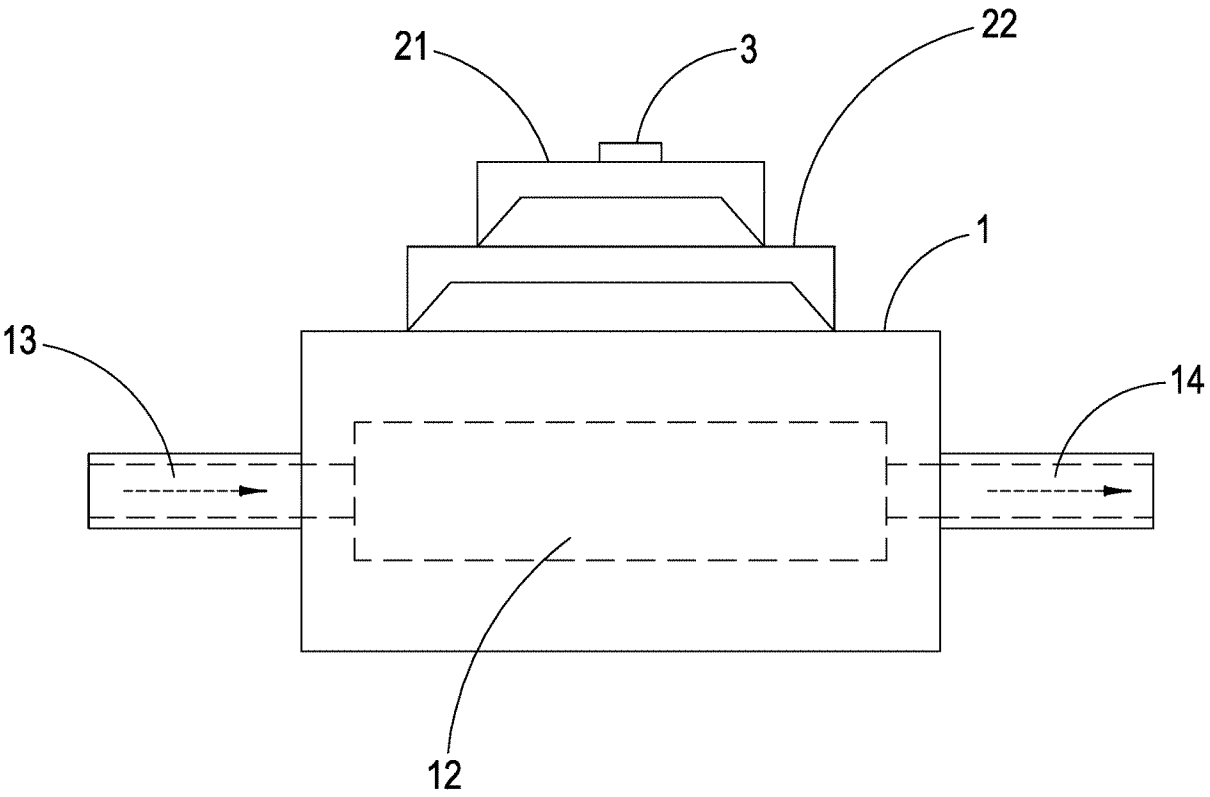
FIG. 6B is an internal schematic view of the structure composite crucibles according to the second aspect of the sixth embodiment of the structures of composite crucibles and high temperature adiabatic method in arc heating process with such disclosed structures.

In addition, as shown in FIG. 6B, the graphite platform 22 contacts with the copper platform 1 through at least two points or two lines, and the two graphite platforms 21 and 22 contact with each other through at least two points or two lines, such that the graphite platform 21 can be fixed on the graphite platform 22, and there are fewer contacts between the two graphite platforms 21 and 22, so that the thermal insulation is better and longer.

Figure 7:
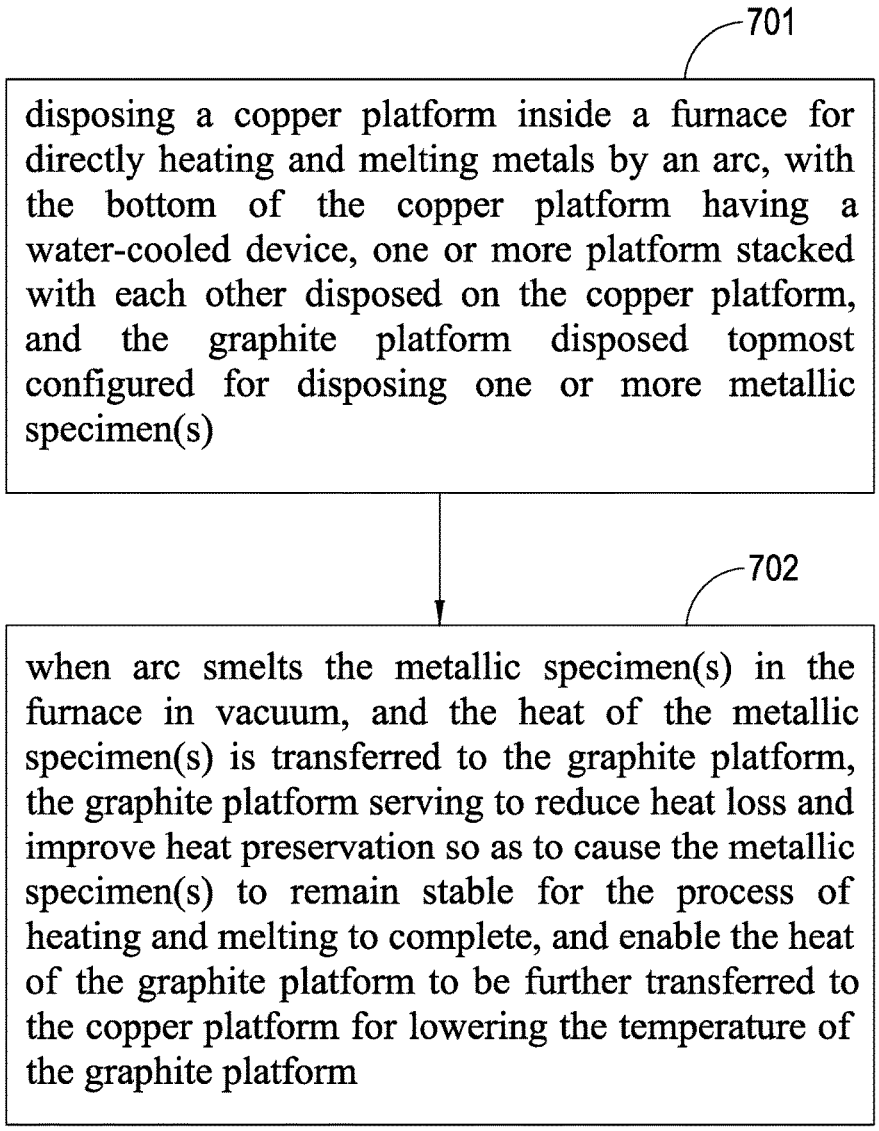
FIG. 7 is a flow chart of the high temperature adiabatic method in arc heating process according to the first aspect of the structures of composite crucibles and high temperature adiabatic method in arc heating process with such disclosed structures.

As shown in FIG. 7, which is a flow chart of a high temperature adiabatic method in arc heating and melting process. The disclosed method in this embodiment may include:

(1) disposing a copper platform inside a furnace for directly heating and melting metals by an arc, with the bottom of the copper platform having a water-cooled device, one or more platform stacked with each other disposed on the copper platform, and the graphite platform disposed topmost configured for disposing one or more metallic specimen(s) (701), and (2) when arc smelts the metallic specimen(s) in the furnace in vacuum, and the heat of the metallic specimen(s) is transferred to the graphite platform, the graphite platform serving to reduce heat loss and improve heat preservation so as to cause the metallic specimen(s) to remain stable for the process of heating and melting to complete, and enable the heat of the graphite platform to be further transferred to the copper platform for lowering the temperature of the graphite platform (702).

According to the disclosure, the structure of composite crucibles and the high temperature adiabatic method in an arc heating process thereof of the disclosure, as compared with conventional technics, have the following advantages:

(1) According to the graphite platform of the disclosure, when the temperature is higher, the thermal conductivity is decreased, such that the graphite platform may enter to an adiabatic condition under an extremely high temperature. Thus, it can reduce heat loss and thermal insulation can be improved. Further, the materials having a melting point higher than 3000° C. can still be used in the melting process.

(2) According to the disclosure, when the casting solution formed after melting is cooled down, casts are formed with different appearances based on the appearances of the holes.

Note that the specifications relating to the above embodiments should be construed as exemplary rather than as limitative of the present disclosure. The equivalent variations and modifications on the structures or the process by reference to the specification and the drawings of the disclosure, or application to the other relevant technical fields directly or indirectly should be construed similarly as falling within the protection scope of the disclosure.

What is claimed is:

1. A structure of composite crucibles, comprising:

a copper platform; and one or more graphite platform(s) stacked with each other and disposed on the copper platform, wherein the graphite platform disposed topmost is configured for disposing one or more metallic specimen(s), and the graphite platform configured for disposing the metallic specimen(s) has at least one hole therein, and the hole is configured for disposing the metallic specimen(s), and one or more graphite platform disposed between the graphite platform configured for disposing the metallic specimen(s) and the copper platform has at least one hole configured for connecting with the hole inside the graphite platform configured for disposing the metallic specimen(s).

2. The structure of composite crucibles according to claim 1, wherein the graphite platform contacting with the copper platform contacts with the copper platform through at least two points, such that the graphite platform is fixed on the copper platform.

3. The structure of composite crucibles according to claim 1, wherein any of the graphite platforms contacts with another graphite platform through at least two points, such that any of the graphite platforms is fixed on another graphite platform.

4. The structure of composite crucibles according to claim 1, wherein the area of the copper platform is greater than the area of the graphite platform.

5. The structure of composite crucibles according to claim 1, wherein the graphite platform configured for disposing the metallic specimen(s) has at least one hole therein, and the hole is configured for disposing the metallic specimen(s).

6. The structure of composite crucibles according to claim 5, wherein the peripheral of the hole of the graphite platform configured for disposing the metallic specimen(s) has at least one groove, and the groove is configured to fix the metallic specimen(s) to the hole more firmly.

7. The structure of composite crucibles according to claim 1, wherein the graphite platform configured for disposing the metallic specimen(s) has at least one hole therein, and the hole is configured for disposing the metallic specimen(s), all of the graphite platforms disposed between the graphite platform are configured for disposing the metallic specimen(s) and the copper platform and the copper platform has at least one hole configured for connecting with the hole inside the graphite platform configured for disposing the metallic specimen(s).

8. The structure of composite crucibles according to claim 1, wherein the bottom of the copper platform has a water-cooled device, and the water-cooled device is configured for exchanging heat.

* * * * *